US010533408B2

(12) United States Patent
Ochoa Perez et al.

(10) Patent No.: US 10,533,408 B2
(45) Date of Patent: Jan. 14, 2020

(54) OPTIMIZATION OF DRILLING ASSEMBLY RATE OF PENETRATION

(71) Applicant: M-I L.L.C., Houston, TX (US)

(72) Inventors: Luis Manuel Ochoa Perez, Sugar Land, TX (US); Robert Utter, Sugar Land, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 15/557,472

(22) PCT Filed: Mar. 8, 2016

(86) PCT No.: PCT/US2016/021290
§ 371 (c)(1),
(2) Date: Sep. 12, 2017

(87) PCT Pub. No.: WO2016/148964
PCT Pub. Date: Sep. 22, 2016

(65) Prior Publication Data

US 2018/0066508 A1 Mar. 8, 2018

Related U.S. Application Data

(60) Provisional application No. 62/132,575, filed on Mar. 13, 2015.

(51) Int. Cl.
*E21B 44/02* (2006.01)
*E21B 4/02* (2006.01)
*E21B 45/00* (2006.01)

(52) U.S. Cl.
CPC ..... *E21B 44/02* (2013.01); *E21B 4/02* (2013.01); *E21B 45/00* (2013.01)

(58) Field of Classification Search
CPC . E21B 44/00; E21B 44/02; E21B 4/02; E21B 45/00
See application file for complete search history.

(56) References Cited

U.S. PATENT DOCUMENTS 4,660,656 A 4/1987 Warren et al.
5,368,108 A * 11/1994 Aldred ..... E21B 44/005 175/40

(Continued)

FOREIGN PATENT DOCUMENTS

WO 2012/100259 A2 7/2012

OTHER PUBLICATIONS

International Search Report and Written Opinion for the equivalent International patent application PCT/US2016/021290 dated Jun. 24, 2016.

(Continued)

*Primary Examiner* — Giovanna C Wright
*Assistant Examiner* — Yanick A Akaragwe
(74) *Attorney, Agent, or Firm* — Jeffrey D. Frantz

(57) ABSTRACT

In drilling into a subterranean formation, several factors influence the rate of penetration, including, but not limited to, the type of formation being drilled, the weight on bit, and the rotational speed of the drill bit. Disclosed are a system and method for controlling the rotational speed of a drill bit based on regulation of fluid flow to the motor driving the bit, while maintaining at least a minimum flow of fluid to the annulus to clear debris from downhole during drilling. Regulation of fluid flow to the motor and to the annulus may be accomplished utilizing a flow diverter configured to adjust a flow ratio depending on drilling conditions in order to maximize efficiency of the motor downhole during drilling.

18 Claims, 5 Drawing Sheets

(56) References Cited

U.S. PATENT DOCUMENTS

| | | | |
|---|---|---|---|
| 6,349,763 | B1 | 2/2002 | Estep et al. |
| 6,494,264 | B2 | 12/2002 | Pringle et al. |
| 6,543,532 | B2 | 4/2003 | Estep et al. |
| 6,976,542 | B2 | 12/2005 | Henriksen et al. |
| 7,044,229 | B2 | 5/2006 | Tennoy et al. |
| 7,055,605 | B2 | 6/2006 | Howlett et al. |
| 7,114,574 | B2 | 10/2006 | Bissonnette et al. |
| 7,246,668 | B2 | 7/2007 | Smith |
| 7,299,885 | B2 | 11/2007 | Baird |
| 7,331,392 | B2 | 2/2008 | Bosley et al. |
| 7,347,286 | B2 | 3/2008 | Hu |
| 7,350,590 | B2 | 4/2008 | Hosie et al. |
| 7,377,327 | B2 | 5/2008 | Jackson |
| 7,464,758 | B2 | 12/2008 | Yeo et al. |
| 7,533,728 | B2 | 5/2009 | Winslow et al. |
| 7,584,801 | B2 | 9/2009 | deBoer |
| 7,640,990 | B2 | 1/2010 | Ross et al. |
| 7,770,648 | B2 | 8/2010 | Anderson |
| 7,798,251 | B2 | 9/2010 | Eriksen et al. |
| 7,861,790 | B2 | 1/2011 | Lembcke et al. |
| 7,909,095 | B2 | 3/2011 | Richards et al. |
| 8,016,033 | B2 | 9/2011 | Iblings et al. |
| 8,118,098 | B2 | 2/2012 | Hromas et al. |
| 8,201,633 | B2 | 6/2012 | Hilliard |
| 2003/0029308 | A1 | 2/2003 | Van Drentham-Susman et al. |
| 2005/0211471 | A1 | 9/2005 | Zupanick |
| 2006/0124352 | A1 | 6/2006 | Krueger et al. |
| 2007/0246265 | A1 | 10/2007 | deBoer |
| 2007/0272410 | A1 | 11/2007 | Hromas et al. |
| 2008/0164062 | A1 | 7/2008 | Brackin et al. |
| 2009/0056952 | A1 | 3/2009 | Churchill |
| 2009/0242210 | A1 | 10/2009 | George et al. |
| 2009/0272580 | A1 | 11/2009 | Dolman et al. |
| 2010/0084130 | A1 | 4/2010 | Richards et al. |
| 2011/0203809 | A1 | 8/2011 | Knobloch, Jr. et al. |
| 2014/0129148 | A1* | 5/2014 | Harmer ..... E21B 44/005 702/9 |
| 2017/0016290 | A1 | 1/2017 | Manwill et al. |

OTHER PUBLICATIONS

International Preliminary Report on Patentability for the equivalent International patent application PCT/US2016/021290 dated Sep. 28, 2017.

* cited by examiner

OPTIMIZATION OF DRILLING ASSEMBLY RATE OF PENETRATION

CROSS-REFERENCE TO RELATED APPLICATION

The present document is based on and claims priority to U.S. Provisional Application Ser. No. 62/132,575, filed Mar. 13, 2015, which is incorporated herein by reference in its entirety.

BACKGROUND

A subterranean formation can be drilled with a drill string having a drill bit located on a distal end of the drillstring. A motor can be operatively coupled to rotate the drill bit. During drilling, the rate of penetration (ROP) may be used to measure how quickly the drill bit penetrates the formation. While several factors influence the ROP, the ROP primarily depends on the type of formation being drilled, the weight on bit (WOB), and the rotational speed (revolutions per minute (RPM)) of the drill bit. As the type of formation being drilled is predetermined, operators may vary the WOB and select a downhole motor with appropriate RPM capabilities to impact the ROP during operation.

The relationship between the WOB and RPM for a particular model and size of drilling motor can be represented by a power curve. The power curve is used to determine the energy delivered to the bit for a given WOB and RPM. Although other factors, for example, torque, vibration, fluid rheology, and other features of the fluid, may affect the power curve (as well as the ROP) WOB and RPM play stronger roles in defining a power curve for a given motor.

The WOB can be adjusted at the drill rig by putting more weight on the drill bit or carrying more of the weight of the drill string on the drill rig. However, adjusting the RPM during operation is not as straightforward. As noted above, drilling motors drive the rotation of the drill bit and determine the RPM of the drill bit. Motors, e.g., mud motors, may be driven by drilling fluid pumped from surface equipment through the drillstring. The volume of fluid supplied to the mud motor is correlated to the speed, i.e., RPM of the motor. For example, a higher flow rate of fluid provided to the motor will generally result in a greater RPM of the drill bit. However, the flow rate and RPMs of the motor generally have a parabolic relationship such that a range of peak efficiency for each motor exists, beyond which, providing greater fluid flow does not result in increased RPMs and may result in damage to the motor and/or bit. Similarly, too little fluid flow can stall a motor.

Additionally, drilling fluid provided to the drill string is used to clean away drill cuttings that accumulate in an annular space ("annulus") between the drill string, including the bottom hole assembly (BHA), and the wall of the borehole. When excessive amounts of cuttings build up in the annulus, the friction on the drill string increases with a corresponding increase of risk of the drill string becoming stuck in the borehole. In general, there is a minimum fluid flow necessary to effectively transport the cuttings up and out of the borehole. To prevent the drill string from becoming stuck, the ROP may be reduced until the excess cuttings are cleared away by the mud flow. In some cases, the flow of drilling fluid provided to the drill string is determined by the cleaning needs of the borehole rather than the RPM of the motor.

DETAILED DESCRIPTION

Generally, embodiments disclosed herein relate to a method of drilling a subterranean formation. More specifically, the present disclosure relates to a method of drilling to optimize a rate of penetration (ROP) by adjusting a flow ratio of a first portion of fluid provided to a motor driving a drill bit and a second portion of fluid directed into an annulus between a drill string and the walls of the borehole to clear debris from the borehole.

Figure 1:
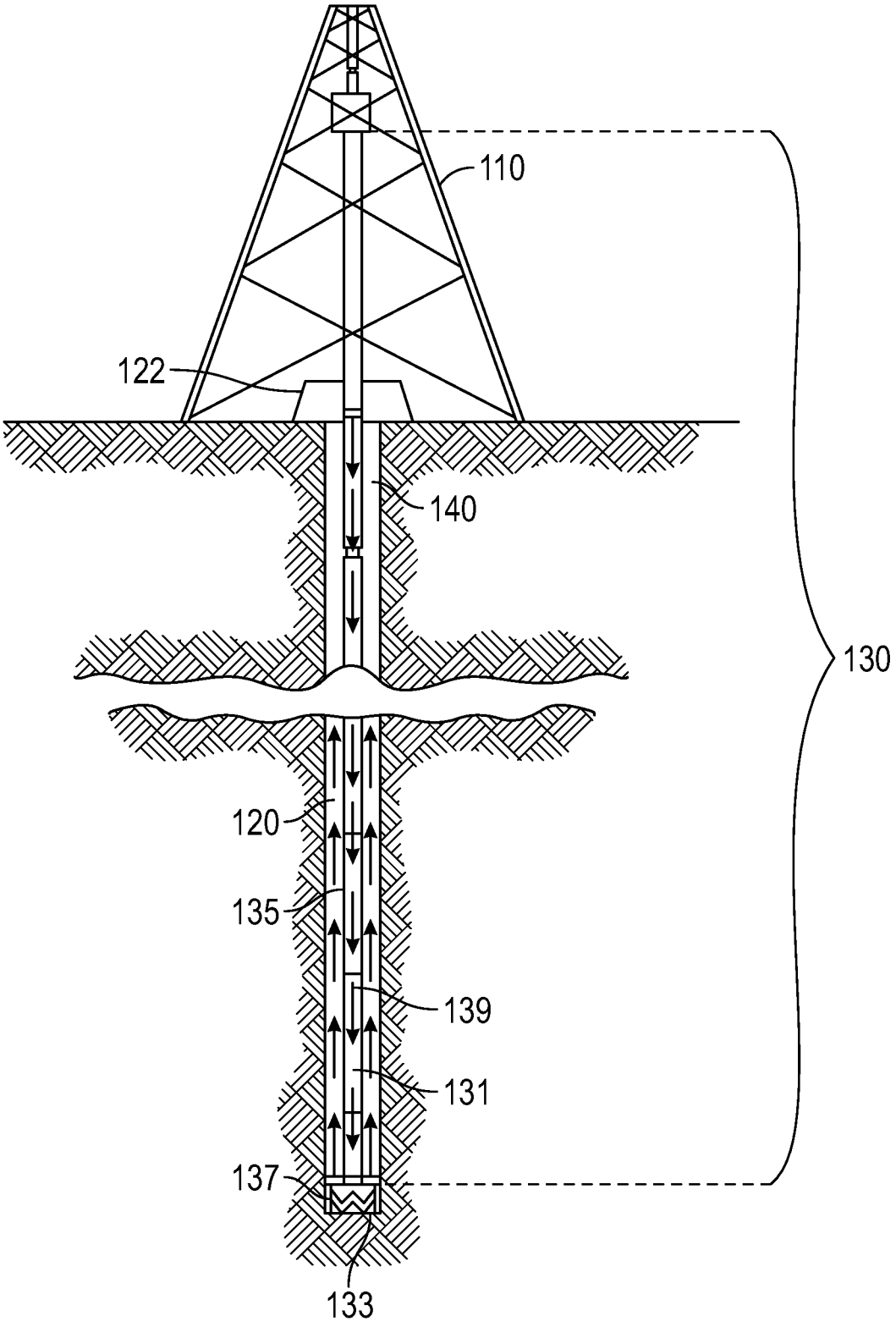
FIG. 1 illustrates a drilling system in accordance with embodiments of the present disclosure.

FIG. 1 shows a drilling system that may be used with methods disclosed herein. The drilling system includes a drill string 130, which may include a BHA 133 having a drill bit 137, a flow diverter 135, a motor 139, and monitoring tools 131, in various configurations and combinations. The motor 139 is coupled to the BHA 133, such that the motor 139 causes rotation of the drill bit 137. The drill string 130 may be suspended and moved longitudinally by a drilling rig 110 or similar hoisting device having a rotary table 122 or equivalent. The drill string 130 may be assembled from threadably coupled segments ("joints") of drill pipe or other forms of conduit. The drill string 130 may be disposed in a borehole 140 such that an annulus 120 is formed between the drill string 130 and the walls of the borehole 140.

The flow diverter 135 may be located in the drill string 130 above the motor 139, drill bit 137 and/or any measuring tools. The flow diverter 135 may be provided to divert at least a first portion of drilling fluid provided to the drill string 130 to the motor 139 and at least a second portion of drilling fluid to the annulus 120. The first portion of fluid, also referred to as BHA flow may be expelled through the bottom of the BHA 133 through the drill bit 137 to aid in clearing cuttings from the borehole 140. The fluid discharged through the BHA may enter the annulus 120 and flow upward. The second portion of drilling fluid may directed to annulus above the motor 139 in order to clear cuttings from the borehole 140.

The flow diverter 135 may split the flow on demand whilst deployed downhole, such that the ratio of the volume of the first portion of fluid to the second portion of fluid is in a range from 100:0 (i.e., all flow is diverted to the motor 139) to 0:100 (i.e., all flow is directed to the annulus 120). As used in this disclosure, the terms "first portion of fluid" and "BHA flow" are used to refer to the same stream of fluid, while the terms "second portion of fluid" and "bypass flow" are used to refer to the same stream of fluid. Additionally, the term "flow ratio" will refer to the ratio of BHA flow to bypass flow. One example of a flow diverter that may be used in accordance with embodiments disclosed herein is shown and described in U.S. Provisional Application No. 61/983,501 and U.S. Provisional Application No. 61/944,771, assigned to the assignee of the present application, and incorporated herein by reference in its entirety.

The motor 139 is provided to the drill string 130 to rotate the drill bit 137. The first portion of fluid provided to motor 139 drives the rotation of the motor. That is, the motor RPM is correlated to the flow rate of the first portion of fluid. As the RPM of the motor, as well as the RPM of the drill bit 137, is dependent on the flow rate of the first portion of fluid, both the pump rate of fluid from the surface and the flow ratio affect the motor 139 and drill bit 137 RPM. In some embodiments, the flow diverter 135 may be calibrated with the motor 139 and the drill bit 137 prior to drilling, such that, for a given pump rate of fluid flow rate from the surface, a given flow ratio will correspond to a particular RPM of the motor 139 and RPM of the drill bit 137. In other embodiments, a user or a control center may estimate the resulting RPM of the drill bit based on drilling conditions and motor data.

The BHA 133 is provided to a downhole end of the drill string 130 to control the geometry and direction of the borehole. The BHA 133 may include, for example, but not limited to, a drill bit 137, a plurality of nozzles, drill collars, a reamer, and/or a stabilizer (not shown). The plurality of nozzles may be located, for example, on a bottom face or side surface of the drill bit 137 to direct the first portion of fluid to the bottom hole and then upwards within the annulus 120 to clear away cuttings from the borehole.

The drill string 130 may also include a variety of monitoring tools. The monitoring tools may include, for example, but not limited to, measurement while drilling (MWD) tools, rotary steerable tools, and logging while drilling (LWD) tools. These tools may be provided to measure at least one parameter of the formation, for example, porosity, permeability and/or resistivity. The monitoring tools may be located in a measurement sub 131 or may be located at other points along the drill string 130, for example on the BHA 133 and/or motor 139. One skilled in the art will understand that placement of the monitoring tools is not intended to limit the scope of the present disclosure.

The monitoring tools 131 include communication devices (not separately shown) for transmitting various sensor measurements to the surface, e.g., to a control center. These communication devices may include, but are not limited to, mud telemetry, wireline communication, wireless communication, and other downhole communication devices known in the art. The control center may include a computer having a processor. The computer may allow a user to monitor the conditions of the drill string, borehole, and the formation from the surface. The drill string may also receive command signals from the control center and/or user to actuate components of the drills string 130, e.g., a reamer, the flow diverter 135, etc.

Figure 2:
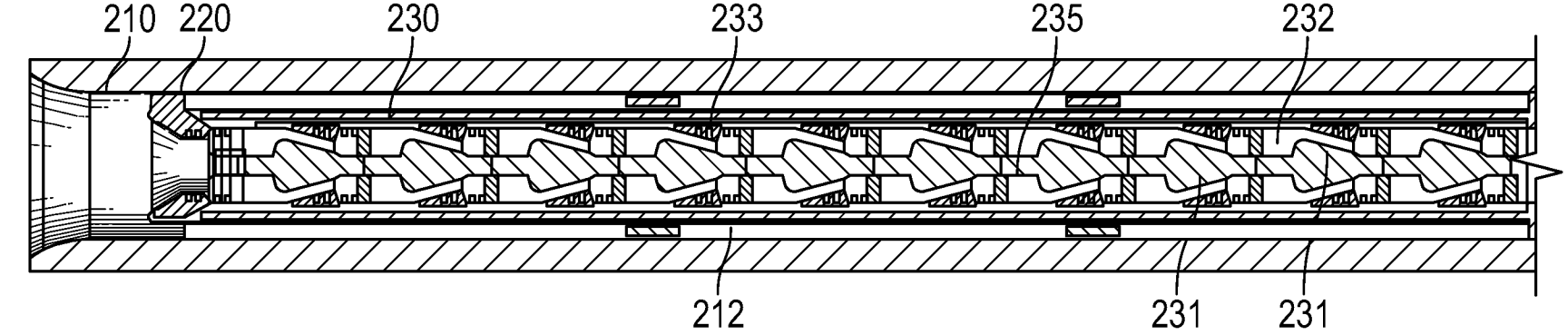
FIG. 2 illustrates a flow diverter in accordance with embodiments of the present disclosure.

Referring to FIG. 2, a flow diverter 135 may include at least a tubular housing 210, e.g., a drill collar, a bypass element 220 located at a first end of the tubular housing 210, a choke housing 230 positioned within the tubular housing 210 below the bypass element 220, and an actuation system (300 in FIG. 3) to control flow through the bypass element between a fully opened and fully closed position. The actuation system may also be in communication with the control center.

The flow diverter 135 may include an outer cavity 212 described by the space between the choke housing 230 and the drilling collar 210, through which the second portion of fluid may travel. The choke housing 230 includes, a plurality of chokes 231 located within the choke housing 230. An inner cavity 232 is described by the space between the plurality of chokes 231 and an inner wall of the choke housing 230 through which the first portion of fluid may travel. The bypass element 220, located near an upper end of the choke housing 230 may direct the flow to the inner cavity 232 and outer cavity 212, thereby splitting the flow into the first and second portions of flow, respectively.

The inner wall of choke housing 230 may include a plurality of choke seats 233 to receive each of the plurality of chokes 231. The plurality of chokes 231 operate between a fully open position, i.e., flow ratio of 100:0, and a fully closed position, i.e., flow ratio of 0:100. When the chokes 231 are seated in the choke seats 233, i.e., flush against the choke seats 233, the chokes are in a fully closed position. When the chokes 231 have a maximum clearance between the plurality of chokes 231 and a corresponding choke seat 233, the chokes are in a fully open position. Each of the plurality of chokes 231 may be connected to an operating rod 235 so that the chokes 231 are actuated together.

Figure 3:
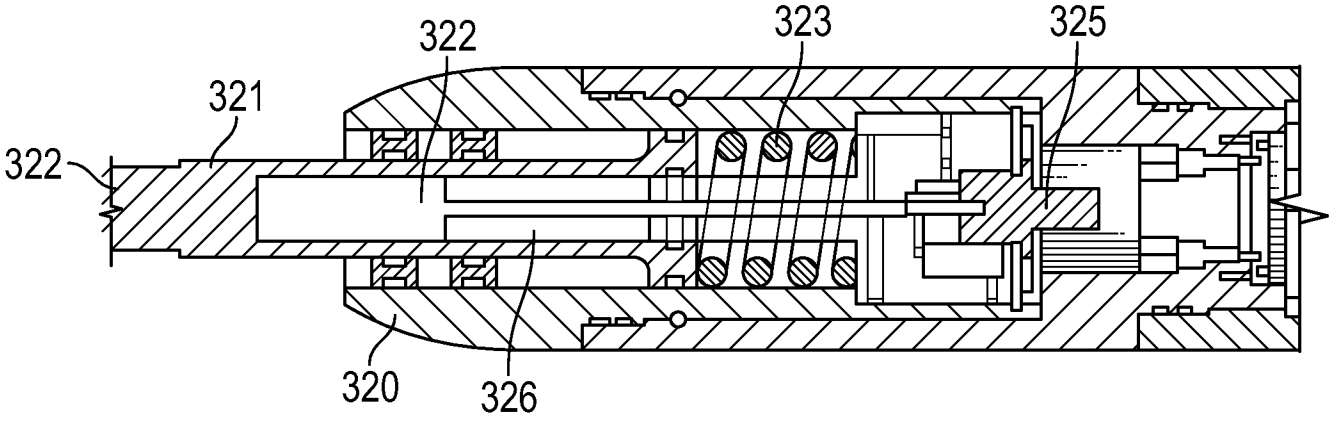
FIG. 3 illustrates an actuation system of a flow diverter in accordance with embodiments of the present disclosure.

The operating rod 235 may be coupled to the actuation system 300 shown in FIG. 3. The actuation system 300 may be located in a tubular housing (210 in FIG. 2) downhole from the choke housing 230 such that an annulus in fluid communication with the first portion of fluid flow is formed between the actuation system 300 and the tubular housing. The actuation system 300 may include at least actuation housing 320 a piston 321, a spring 323, and a valve assembly 325. The piston 321 may be biased in a first position by the spring 323, e.g., in an up hole position. The valve assembly 325 may be in fluid communication with the piston 321 through flow line 326, for example flow line 326 may flow fluid to and/or remove fluid, i.e., a relatively incompressible fluid, from an inner chamber 324 of the piston 321 to pressurize said inner chamber 324. The an upper end 322 of the piston 321 may be coupled to the operating rod 235 using coupling methods known in the art, such that an up hole position of the piston may correspond to an up hole position of the operating rod. One skilled in the art will understand, that although a limited number of embodiments have been described with respect to a flow diverter, other embodiments of a flow diverter may be used without departing from the scope of the present disclosure.

Figure 4:
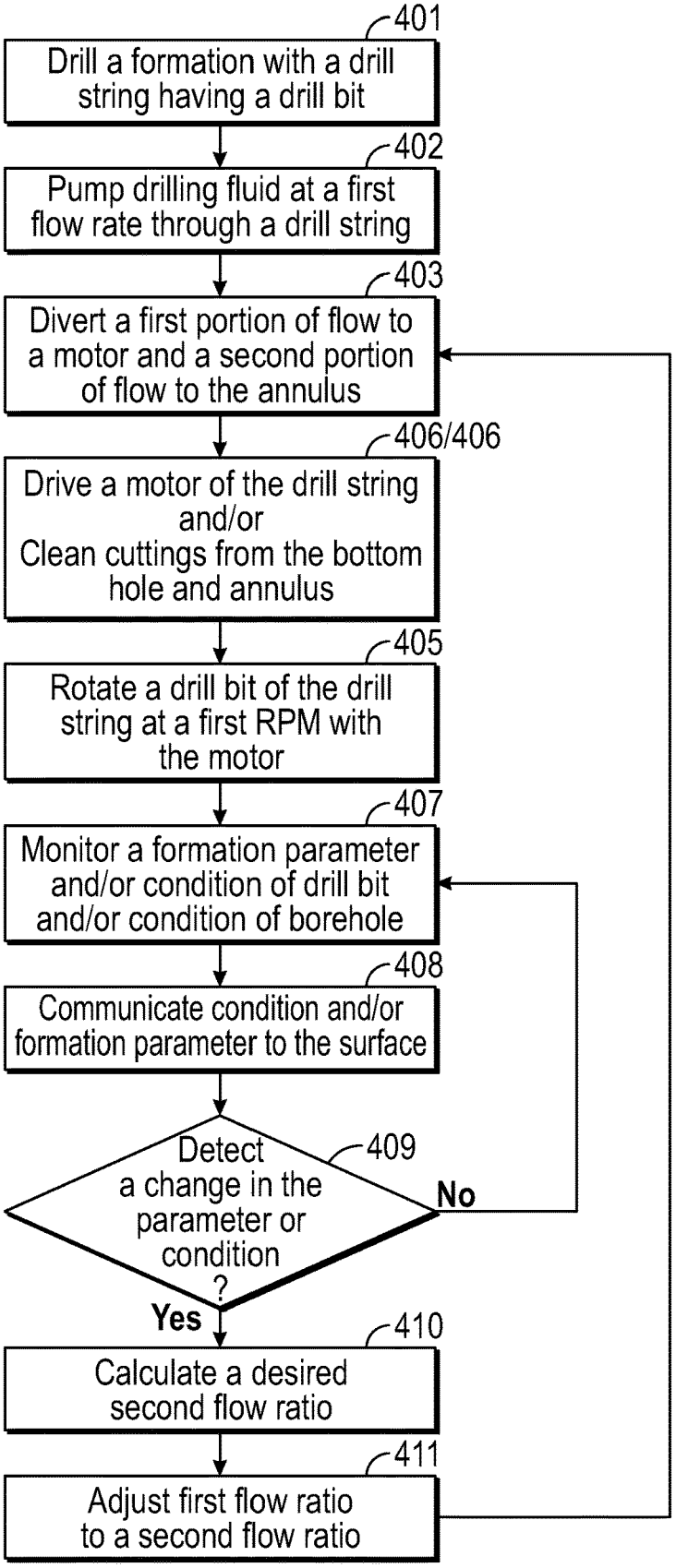
FIGS. 4-7 depict flow diagrams for a method of drilling in accordance with the present disclosure.

The drilling system illustrated in FIG. 1 may be used to drill a formation in accordance with embodiments disclosed herein. Referring to FIGS. 1 and 4 together, a drilling system having at least a drill string 130 and a drill bit 137 may be used to drill 401 a formation. The drill string 130 may also include at least a motor 139 and/or a flow diverter 135. Drilling fluid may be pumped 402 from the surface through the drill string 130 at a first flow rate. The fluid pumped from the surface may be diverted 403 to the annulus 120 and/or a motor 139. For example, flow diverter 135 may divert 403 a first portion of fluid to the motor 139 and a second portion of fluid to the annulus 120.

When drilling commences the flow diverter 135 may be in a first position thereby resulting in a first flow ratio. For example, the first position of the flow diverter 135 may correspond to a flow ratio of 50:50, that is 50% of the flow from the surface is directed to the motor 139 and 50% of the flow from the surface is directed to the annulus 120. One skilled in the art will appreciate that the first position of the flow diverter 135 may be configured such that any flow ratio may be used, for example but not limited to 20:80, 80:20, or 100:0. The flow ratio may be determined, by, but not limited to, the type of formation being drilled, the type of drill bit being used, the WOB, minimum flow for clearing of debris from the borehole, and/or any combination listed herein. For example, a flow ratio for drilling a relatively hard formation, e.g., limestone, may be higher, i.e., less flow is diverted as bypass flow, than the flow ratio for drilling a relatively soft formation, e.g., soft shale.

The first portion of fluid pumped through the motor may be forced through the motor 404 and energy from the flow of fluid is converted into rotational force, thereby driving the motor. The rotational force exerted by the motor rotates 405 the drill bit 137. The RPM of the motor 139 and consequently, the RPM of the drill bit 137 is directly correlated to the flow rate of fluid provided to the motor. Thus, when drilling commences, the drill bit 137 may rotate at a first RPM that corresponds to a first flow rate from the surface and a first flow ratio. Once the first portion of fluid has passed through the motor 139, said fluid may be directed to the borehole annulus 120 to aid in carrying cuttings up hole through the annulus 120. The second portion of fluid may be provided to the annulus 120 to further aid in clearing away 406 cuttings from the borehole.

During drilling, monitoring system 131 may monitor 407 at least one formation parameter. For example, an MWD system and/or LWD system may measure a density, porosity, resistivity, and/or other characteristics of the formation being drilled. It should be noted that some monitoring systems can make measurements of conditions ahead of a bit as well. In some embodiments, the monitoring system 131 may monitor a parameter of the drill string, for example, internal pressure, temperature, wear of cutting elements, orientation of the drill string, etc. The monitoring system 131 may communicate 408 the measurements (i.e., at least one formation parameter and/or parameter of the drill string 130) to the surface, for example to a control center, with telemetry, wireline, a wireless system, and other communication systems known in the art.

The measurements from the monitoring system 131 may be monitored by the control system or a user to determine changes 409 in the formation. In some instances, changes in the at least one formation parameter, e.g., porosity, resistivity, permeability, etc., may indicate that the type of formation has changed, for example, from a relatively hard formation, e.g., limestone, to a relatively soft formation, e.g., clay. As described above, the type of formation being drilled may influence a desired flow ratio and RPM of the drill bit. In other instances, monitoring conditions of a drill string, for example, a condition of the drill bit (e.g., if a bit is worn), condition of a reamer, etc., may indicate a change in RPM is desirable.

In response to a change in a formation parameter (e.g., a change in formation type) or condition of the drill string (e.g., a change in the condition of the drill bit) and/or condition of the borehole (e.g., increased accumulation of drill cuttings), the RPM of the drill bit may be adjusted 411 to a second RPM more suitable to accommodate the change in formation parameter or condition of the drill string. The change from a first RPM to a second RPM may be accomplished by adjusting the flow diverter 135 such that the first flow ratio is changed to a second flow ratio. For example, using a flow diverter 135 and actuation system 300 as shown in FIGS. 2 and 3, the axial position of chokes 231, and hence the flow ratio, may be adjusted by the actuation system 300. External forces, e.g., forces from the first portion of fluid flow, may act to push the piston 321 in a downhole direction overcoming the biasing force of the spring 323. Valve assembly 325 may provide fluid to the inner chamber 322 such that a desired axial position of the piston 321 is maintained in the presence of external forces. Specifically, the amount of fluid in the inner chamber 322 of the piston may determine the axial position of the piston 322. The change in flow ratio may increase or decrease the volume of fluid flow to the motor 139, thereby adjusting the RPM of the motor 139 and, therefore, the drill bit 137. In addition to changing the flow ratio, the pump rate of fluid provided downhole may be adjusted to achieve the desired RPM.

The second flow ratio and the new pump rate may be estimated and/or calculated 410 by a user based on a desired second RPM. The desired second RPM may be determined based on the new conditions, i.e., formation parameters and/or condition of the drill string and/or borehole. For example, if the type of formation has changed, a power curve for the drill bit and the new formation may be used to determine a RPM and WOB for the drill bit 137. The WOB may be adjusted at the drill rig, while the new pump rate and second flow ratio may be communicated to the appropriate equipment, i.e., surface pumps and flow diverter 135, respectively. This allows the bypass flow rate to be changed without affecting the desired BHA flow rate.

According to some embodiments, the control center may calculate 410 a second RPM and second flow ratio. The control center may perform these calculations with, for example, software specifically configured to perform ROP optimization. The second RPM may also be calculated by the control center using a power curve. The measurements received by the control center from the measurement tools are used as inputs to calculate the desired second RPM. The control center may then communicate with the flow diverter 135 and the surface pumps to affect the flow ratio and pump rate, respectively, to achieve the desired second RPM, while maintaining a desired bypass flow rate.

Prior to adjusting the first flow rate and, consequently, the amount of fluid directed and/or diverted to the motor and first RPM, drilling may be stopped. The drilling may be stopped for example once a new formation has been detected, when the cutters on the drill bit are determined to be substantially worn, when the drilling is halted to add more joints of drill pipe to the borehole, and/or once a new desired RPM has been determined.

The user control center and/or user may communicate the second flow ratio to the drill string 130. For example, the control center may automatically send a signal to the drill string to adjust the first RPM to the calculated second RPM. More specifically, the control center may send the signal to the flow diverter 135 to adjust the flow ratio, thereby affecting the volume of fluid directed to the motor 139. In another example, a user may send the signal to the drill string 130 to adjust the first RPM to the second RPM. Once the flow diverter 135 has been adjusted, fluid may once again be pumped downhole to resume drilling. The pump rate of the fluid provided downhole may be different than an initial pump rate. The control center and/or user may communicate with the drill string using, for example, telemetry, wireline, and/or wireless communication devices.

Embodiments described herein may provide for an improved ROP by manipulating an RPM of the drill bit without impacting the amount of fluid provided to the BHA for clearing away cuttings. In other words, the increase or decrease of fluid provided to the motor is independent of the amount of fluid directed to the BHA. Further, by including a flow diverter to divert flow away from the BHA and to the motor, a greater volume of drilling fluid may be provided to the drill string to increase an RPM of the motor without exceeding pressure limits of the drill string.

Figure 5:
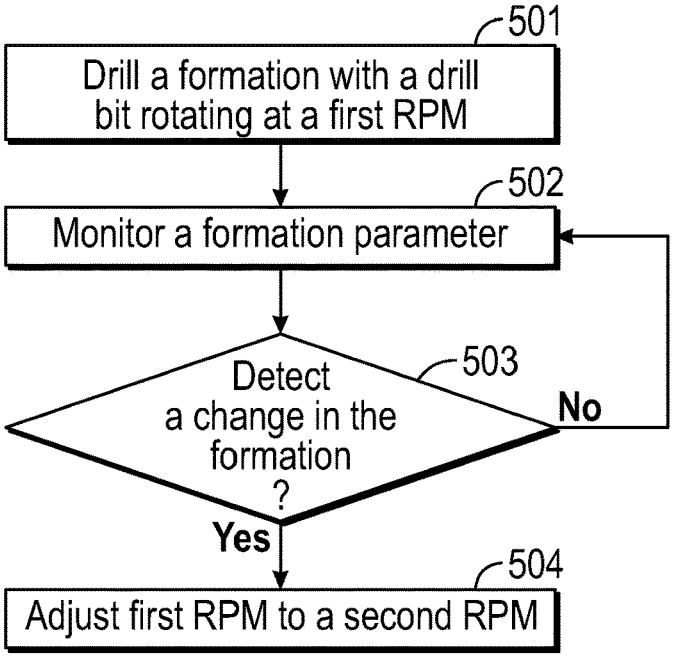

Referring now to FIG. 5, in one embodiment, a method of drilling includes drilling a formation with a drill string having a drill bit that rotates at a first RPM 501. During drilling, at least one formation parameter may be monitored 502. In response to a change in the at least one formation parameter 503, the first PRM may be adjusted to a second RPM 504.

Figure 6:
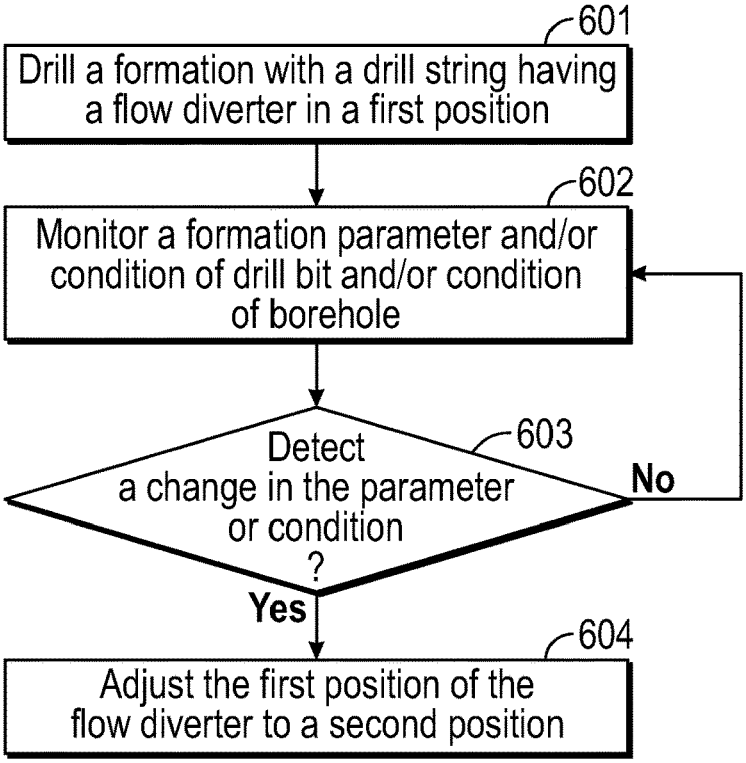

Referring now to FIG. 6, in another embodiment, a method of drilling includes drilling a formation with a drill string 601. The drill string may include a drill bit, a motor, and a flow diverter located therein. During drilling, at least one parameter of the formation or condition of the drill string (e.g., drill bit wear) and/or borehole may be monitored 602. Based on the monitored parameter or condition 603, the flow diverter may be adjusted to increase or decrease fluid flow to the motor 604.

Figure 7:
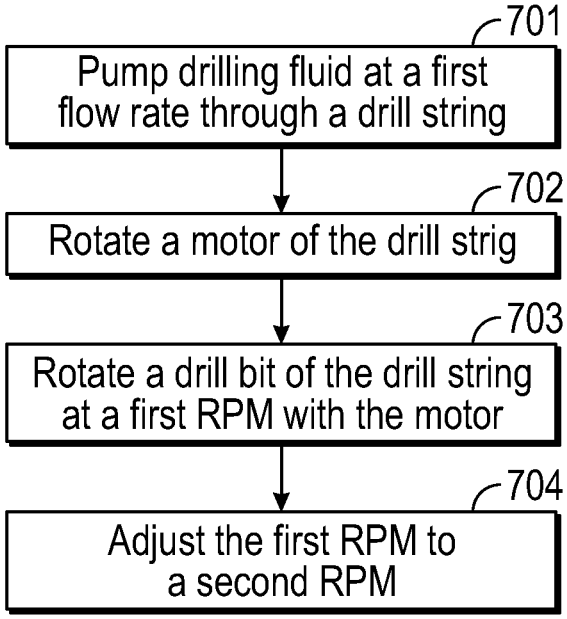

Referring now to FIG. 7, in another embodiment a method of drilling includes pumping drilling fluid at a first flow rate through a drillstring 701. The drill string may include at least a drill bit and a motor located therein. The pumping of drilling fluid may cause the motor to rotate 702, thereby rotating the drill bit at a first RPM to engage and cut a formation 703. During drilling operations, the first RPM may be adjusted to a second RPM 704. This adjustment may be accomplished by adjusting the amount of fluid sent to the motor.

Although only a few example embodiments have been described in detail above, those skilled in the art will readily appreciate that many modifications are possible in the example embodiments without materially departing from this invention. Accordingly, such modifications are intended to be included within the scope of this disclosure as defined in the following claims. Moreover, embodiments disclosed herein may be practiced in the absence of any element which is not specifically disclosed.

What is claimed is:

1. A method of drilling comprising:

drilling into a first formation with a drill string having a motor and a drill bit that rotates at a first rotational speed;

monitoring measurements of at least one formation parameter of the first formation;

determining a change in the at least one formation parameter indicative of a second formation, wherein the first formation is a different type of formation than the second formation;

calculating, via software configured to optimize a rate of penetration for the method of drilling, a second rotational speed based on a power curve of the motor for the drill bit and the second formation;

splitting a fluid flow of a drilling fluid through the drill string with a flow diverter into a first portion of the fluid flow and a second portion of fluid flow, wherein a bypass element of the flow diverter directs the first portion of the fluid flow to an inner cavity of the flow diverter and the second portion of the fluid flow to an outer cavity of flow diverter, wherein the outer cavity is disposed between a choke housing of the flow diverter and a tubular housing of the flow diverter and the inner cavity is disposed between a plurality of chokes of the flow diverter and an inner wall of the choke housing; and adjusting the first rotational speed to the second rotational speed such that the drill bit rotates at the second rotational speed.

2. The method of claim 1, wherein the at least one formation parameter of the first formation is at least one selected from the group consisting of porosity, density, resistivity, and permeability.

3. The method of claim 1, further comprising:

diverting the second portion of the fluid flow from a bottom hole assembly to an annulus between the drill string and a borehole wall.

4. The method of claim 3, further comprising:

directing the fluid flow of the drilling fluid with the flow diverter to increase or decrease an amount of drilling fluid flow to the bottom hole assembly.

5. The method of claim 1, further comprising:

stopping drilling prior to adjusting the first rotational speed of the drill bit and resuming drilling thereafter.

6. The method of claim 1, further comprising:

adjusting a first weight on bit to a second weight on bit.

7. A method of drilling comprising:

drilling into a first formation with a drill string, the drill string having a drill bit, a motor, and a flow diverter;

providing a drilling fluid at a first flow rate through the drill string to the drill bit;

monitoring at least one measurement of at least one change in a parameter of the first formation and a first condition of the drill string, wherein the at least one change is indicative of at least one of a second formation different than the first formation and a second condition different of the drill string than the first condition of the drill string; and adjusting the flow diverter to increase or decrease a first fluid flow of the drilling fluid to the motor by operating a plurality of chokes of the flow diverter between a fully open position and a fully closed position such that the first fluid flow to the motor increases or decreases from the first flow rate to a second flow rate based on the at least one measurement of the at least one change, wherein, when the plurality of chokes is in the fully closed position, the plurality of chokes is seated in a plurality of choke seats of the flow diverter and, when the plurality of chokes is in the fully opened position, a maximum clearance is disposed between the plurality of chokes and the plurality of choke seats.

8. The method of claim 7, wherein the adjusting further comprises:

diverting at least a portion of the drilling fluid to an annulus.

9. The method of claim 7, wherein the increase or decrease of the first fluid flow to the motor is inversely proportional to a second fluid flow of the drilling fluid diverted to an annulus.

10. The method of claim 7, wherein the adjusting is performed in response to a change in a condition of the bit.

11. The method of claim 7, wherein adjusting the flow diverter occurs once the flow diverter is below a rotary table.

12. The method of claim 7, wherein each choke of the plurality of chokes is connected to an operating rod such that the plurality of chokes is actuated together.

13. A method of drilling comprising:

pumping drilling fluid at a first flow rate through a drill string, the drill string having a motor and a drill bit;

rotating the drill bit with the motor at a first rotational speed to engage and cut a first formation;

determining a second rotational speed based on at least one monitored condition indicative of a second formation different than the first formation, wherein the determined second rotational speed is calculated, via software configured to optimize a rate of penetration for the method of drilling, based on a power curve of the motor for the drill bit and the second formation;

diverting a first portion of the drilling fluid sent downhole to the motor with a flow diverter, wherein a bypass element of the flow diverter directs the first portion to an inner cavity of the flow diverter and a second portion of the drilling fluid to an outer cavity of the flow diverter, the outer cavity is disposed between a choke housing of the flow diverter and a tubular housing of the flow diverter, and the inner cavity is disposed between a plurality of chokes of the flow diverter and an inner wall of the choke housing; and adjusting the first rotational speed to the second rotational speed by adjusting the amount of drilling fluid sent to the motor such that the drill bit rotates at the second rotational speed.

14. The method of claim 13, further comprising: sending a signal to the flow diverter to adjust a flow ratio of the flow diverter thereby adjusting the first rotational speed to the second rotational speed.

15. The method of claim 13, further comprising:

monitoring at least one parameter of the first formation or the second formation or a condition of the drill string with a control center.

16. The method of claim 15, further comprising:

inputting the at least one parameter or the condition into the control center and calculating the second rotational speed.

17. The method of claim 15, further comprising:

automatically sending a signal from the control center to the drill string to adjust the first rotational speed to the second rotational speed.

18. The method of claim 15, further comprising:

maintaining a desired flow rate to the drill bit while adjusting the first rotational speed to the second rotational speed.

* * * * *